US009233278B2

(12) United States Patent
Sajima et al.

(10) Patent No.: US 9,233,278 B2
(45) Date of Patent: Jan. 12, 2016

(54) GOLF BALL

(75) Inventors: Takahiro Sajima, Kobe (JP); Hirotaka Nakamura, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 712 days.

(21) Appl. No.: 13/439,088

(22) Filed: Apr. 4, 2012

(65) Prior Publication Data

US 2012/0270684 A1 Oct. 25, 2012

(30) Foreign Application Priority Data

Apr. 19, 2011 (JP) ..... 2011-092589

(51) Int. Cl.
*A63B 37/12* (2006.01)
*A63B 37/00* (2006.01)

(52) U.S. Cl.
CPC ..... *A63B 37/0006* (2013.01); *A63B 37/0003* (2013.01); *A63B 37/0019* (2013.01); *A63B 37/0056* (2013.01); *A63B 37/0064* (2013.01); *A63B 37/0083* (2013.01); *A63B 37/002* (2013.01); *A63B 37/0075* (2013.01)

(58) Field of Classification Search
CPC ..... A63B 37/0006; A63B 37/002
USPC ..... 473/380
See application file for complete search history.

(56) References Cited

U.S. PATENT DOCUMENTS

| | | | | |
|---|---|---|---|---|
| 4,762,326 | A * | 8/1988 | Gobush | 473/380 |
| 4,948,143 | A * | 8/1990 | Aoyama | 473/382 |
| 4,971,330 | A | 11/1990 | Morell | |
| 5,078,402 | A | 1/1992 | Oka | |
| 5,092,604 | A | 3/1992 | Oka | |
| 5,123,652 | A | 6/1992 | Oka | |
| 5,586,951 | A | 12/1996 | Sugiura | |
| 8,038,548 | B2 * | 10/2011 | Felker et al. | 473/380 |
| 2004/0152541 | A1 * | 8/2004 | Sajima | 473/378 |

FOREIGN PATENT DOCUMENTS

| | | | |
|---|---|---|---|
| JP | 63-186670 | A | 8/1988 |
| JP | 1-221182 | A | 9/1989 |
| JP | 2-211181 | A | 8/1990 |
| JP | 8-84787 | A | 4/1996 |
| JP | 2844905 | B2 | 10/1998 |
| JP | 2002-331044 | A | 11/2002 |

* cited by examiner

*Primary Examiner* — Raeann Gorden
(74) *Attorney, Agent, or Firm* — Birch, Stewart, Kolasch & Birch, LLP

(57) ABSTRACT

The surface of a golf ball 2 is divided by four comparting great circles CG into six spherical quadrangles Ss and eight spherical triangles St. The eight spherical triangles St are composed of four first spherical triangles St1 and four second spherical triangles St2. Dimple patterns of the six spherical quadrangles Ss are the same. Dimple patterns of the four first spherical triangles St1 are the same. Dimple patterns of the four second spherical triangles St2 are the same. The dimple pattern of each first spherical triangle St1 is different from the dimple pattern of each second spherical triangle St2. The comparting great circles CG are obtained by projecting the 24 sides of a cuboctahedron inscribed in a phantom sphere of the golf ball 2 on the surface of the phantom sphere.

17 Claims, 14 Drawing Sheets

GOLF BALL

This application claims priority on Patent Application No. 2011-92589 filed in JAPAN on Apr. 19, 2011. The entire contents of this Japanese Patent Application are hereby incorporated by reference.

BACKGROUND OF THE INVENTION

1. Field of the Invention

The present invention relates to golf balls. Specifically, the present invention relates to improvement of dimples of golf balls.

2. Description of the Related Art

Golf balls have a large number of dimples on the surfaces thereof. The dimples disturb the airflow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

In designing a dimple pattern, the surface of a golf ball is divided into a plurality of units. Dimples are located in each unit. For the purpose of obtaining the units, a regular polyhedron or quasi-regular polyhedron inscribed in a phantom sphere of the golf ball may be used. By projecting the sides of these polyhedrons on the phantom sphere, comparting lines are obtained. By the comparting lines, the units are obtained. Examples of the regular polyhedron include a regular hexahedron, a regular octahedron, a regular dodecahedron, and a regular icosahedron. Examples, of the quasi-regular polyhedron include a cuboctahedron and an icosidodecahedron.

In a dimple pattern based on a cuboctahedron, the surface of a golf ball is divided into spherical quadrangles and spherical triangles. The dimple pattern based on the cuboctahedron is varied. In a golf ball having this pattern, turbulization can be prompted. Documents disclosing a dimple pattern based on a cuboctahedron are, for example, JPS63-186670, JPH1-221182, JPH2-211181, and JP2002-331044.

The greatest interest of golf players concerning golf balls is flight distance. In light of flight performance, there is room for further improvement in the dimple pattern based on the cuboctahedron. An object of the present invention is to provide a golf ball having excellent flight performance.

SUMMARY OF THE INVENTION

A golf ball according to the present invention has a large number of dimples on a surface thereof. When a surface of a phantom sphere of the gold ball is divided into six spherical quadrangles and eight spherical triangles by four comparting great circles which are formed by projecting sides of a cuboctahedron inscribed in the phantom sphere on the surface of the phantom sphere, the eight spherical triangles include a spherical triangle having a first dimple pattern and a spherical triangle having a second dimple pattern different from the first dimple pattern.

In the golf ball according to the present invention, the dimple pattern is varied. The dimple pattern prompts turbulization. The golf ball has excellent flight performance.

Preferably, each of the eight spherical triangles has either one of the first dimple pattern and the second dimple pattern.

Preferably, the eight spherical triangles include four spherical triangles each having the first dimple pattern and four spherical triangles each having the second dimple pattern. Preferably, each spherical triangle having the first dimple pattern does not share vertices with the other spherical triangles each having the first dimple pattern, and each spherical triangle having the second dimple pattern does not share vertices with the other spherical triangles each having the second dimple pattern.

Preferably, a standard deviation $\eta 31$ of diameters of dimples in the first dimple pattern is different from a standard deviation $\eta 32$ of diameters of dimples in the second dimple pattern. Preferably, an absolute value of a difference between the standard deviation $\eta 31$ and the standard deviation $\eta 32$ is equal to or greater than 0.05 mm.

Preferably, a standard deviation $\eta 4$ of diameters of dimples in a dimple pattern of each spherical quadrangle is different from a standard deviation $\eta 31$ of diameters of dimples in the first dimple pattern and is also different from a standard deviation $\eta 32$ of diameters of dimples in the second dimple pattern. Preferably, the standard deviation $\eta 4$ is greater than the standard deviation $\eta 31$ and is greater than the standard deviation $\eta 32$. Preferably, a difference between the standard deviation $\eta 4$ and the standard deviation $\eta 31$ is equal to or greater than 0.05 mm but equal to or less than 0.5 mm. Preferably, a difference between the standard deviation $\eta 4$ and the standard deviation $\eta 32$ is equal to or greater than 0.05 mm but equal to or less than 0.5 mm.

Preferably, a standard deviation $\eta$ of diameters of all the dimples of the golf ball is different from a standard deviation $\eta 31$ of diameters of dimples in the first dimple pattern and is also different from a standard deviation $\eta 32$ of diameters of dimples in the second dimple pattern. Preferably, the standard deviation $\eta$ is greater than the standard deviation $\eta 31$ and is greater than the standard deviation $\eta 32$. Preferably, a difference between the standard deviation $\eta$ and the standard deviation $\eta 31$ is equal to or greater than 0.05 mm but equal to or less than 0.5 mm. Preferably, a difference between the standard deviation $\eta$ and the standard deviation $\eta 32$ is equal to or greater than 0.05 mm but equal to or less than 0.5 mm.

Preferably, a standard deviation $\eta 4$ of diameters of dimples in a dimple pattern of each spherical quadrangle is equal to or greater than a standard deviation $\eta$ of diameters of all the dimples of the golf ball.

Preferably, each of the four comparting great circles intersects the dimples. Preferably, no great circle which does not intersect any dimple is present on the surface of the phantom sphere. Preferably, each of the four comparting great circles does not coincide with an equator of the golf ball.

Preferably, a standard deviation $\eta 31$ of diameters of dimples in the first dimple pattern is equal to or less than 0.50 mm. Preferably, a standard deviation $\eta 32$ of diameters of dimples in the second dimple pattern is equal to or less than 0.50 mm.

Preferably, a standard deviation $\eta 4$ of diameters of dimples in a dimple pattern of each spherical quadrangle is equal to or greater than 0.10 mm but equal to or less than 0.60 mm.

Preferably, a standard deviation $\eta$ of diameters of all the dimples of the golf ball is equal to or greater than 0.10 mm but equal to or less than 0.60 mm.

DESCRIPTION OF THE PREFERRED EMBODIMENTS

The following will describe in detail the present invention, based on preferred embodiments with reference to the accompanying drawings.

Figure 1:
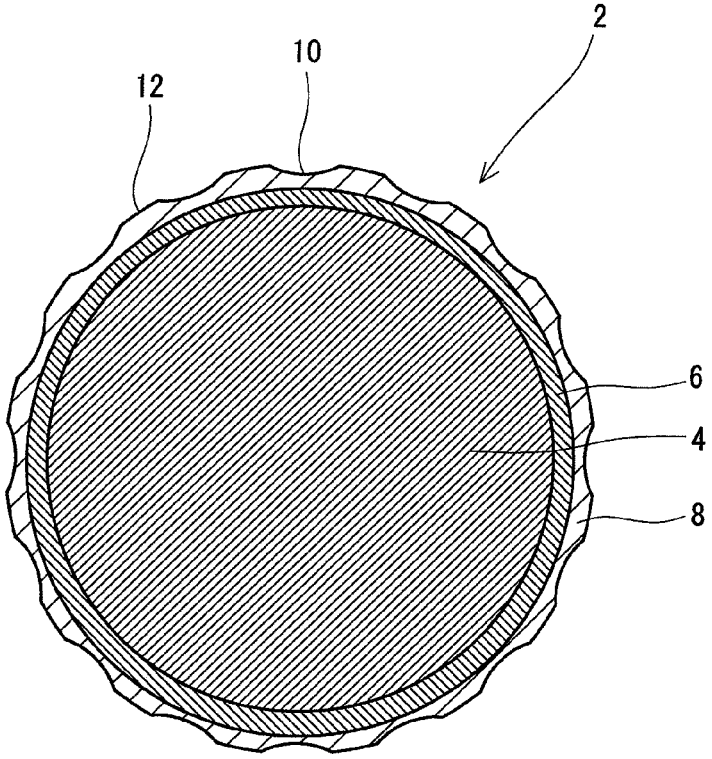
FIG. 1 is a cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. On the surface of the cover 8, a large number of dimples 10 are formed. Of the surface of the golf ball 2, a part other than the dimples 10 is a land 12. The golf ball 2 includes a paint layer and a mark layer on the external side of the cover 8 although these layers are not shown in the drawing.

The golf ball 2 has a diameter of preferably 40 mm or greater but 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of base rubbers of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferred, and high-cis polybutadienes are particularly preferred.

In order to crosslink the core 4, a co-crosslinking agent is suitably used. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy) hexane, and di-t-butyl peroxide.

According to need, various additives such as a filler, sulfur, a vulcanization accelerator, a sulfur compound, an anti-aging agent, a coloring agent, a plasticizer, a dispersant, and the like are included in the rubber composition of the core 4 in an adequate amount. Synthetic resin powder or crosslinked rubber powder may also be included in the rubber composition.

The core 4 has a diameter of preferably 30.0 mm or greater and particularly preferably 38.0 mm or greater. The diameter of core 4 is preferably equal to or less than 42.0 mm and particularly preferably equal to or less than 41.5 mm. The core 4 may be composed of two or more layers. The core 4 may have a rib on the surface thereof. The core 4 may be hollow.

A suitable polymer for the mid layer 6 is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymers and the ternary copolymers, preferable α-olefins are ethylene and propylene, while preferable α,β-unsaturated carboxylic acids are acrylic acid and methacrylic acid. In the binary copolymers and the ternary copolymers, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, other polymers may be used for the mid layer 6. Examples of the other polymers include polystyrenes, polyamides, polyesters, polyolefins, and polyurethanes. Two or more polymers may be used in combination.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the mid layer 6 in an adequate amount. For the purpose of adjusting specific gravity, powder of a metal having a high specific gravity such as tungsten, molybdenum, and the like may be included in the mid layer 6.

The mid layer 6 has a thickness of preferably 0.2 mm or greater and particularly preferably 0.3 mm or greater. The thickness of the mid layer 6 is preferably equal to or less than 2.5 mm and particularly preferably equal to or less than 2.2 mm. The mid layer 6 has a specific gravity of 0.90 or greater and particularly 0.95 or greater. The specific gravity of the mid layer 6 is preferably equal to or less than 1.10 and particularly preferably equal to or less than 1.05. The mid layer 6 may be composed of two or more layers.

The cover 8 is formed from a resin composition. The base polymer of the resin composition is a polyurethane. Thermoplastic polyurethanes and thermosetting polyurethanes can be used. In light of productivity, thermoplastic polyurethanes are preferred. A thermoplastic polyurethane includes a polyurethane component as a hard segment, and a polyester component or a polyether component as a soft segment.

Examples of a curing agent for the polyurethane component include alicyclic diisocyanates, aromatic diisocyanates, and aliphatic diisocyanates. Alicyclic diisocyanates are particularly preferred. Since an alicyclic diisocyanate does not have any double bond in the main chain, the alicyclic diisocyanate suppresses yellowing of the cover 8. Examples of alicyclic diisocyanates include 4,4'-dicyclohexylmethane diisocyanate ($H_{12}MDI$), 1,3-bis(isocyanatomethyl)cyclohexane ($H_6XDI$), isophorone diisocyanate (IPDI), and trans-1,4-cyclohexane diisocyanate (CHDI). In light of versatility and processability, $H_{12}MDI$ is preferred.

Instead of a polyurethane, other polymers may be used for the cover 8. Examples of the other polymers include ionomer resins, polystyrenes, polyamides, polyesters, and polyolefins. Two or more polymers may be used in combination.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 8 in an adequate amount.

The cover 8 has a thickness of preferably 0.2 mm or greater and particularly preferably 0.3 mm or greater. The thickness of the cover 8 is preferably equal to or less than 2.5 mm and particularly preferably equal to or less than 2.2 mm. The cover 8 has a specific gravity of preferably 0.90 or greater and particularly preferably 0.95 or greater. The specific gravity of the cover 8 is preferably equal to or less than 1.10 and particularly preferably equal to or less than 1.05. The cover 8 may be composed of two or more layers.

The golf ball 2 may include a reinforcing layer between the mid layer 6 and the cover 8. The reinforcing layer firmly adheres to the mid layer 6 and also to the cover 8. The reinforcing layer suppresses separation of the cover 8 from the mid layer 6. Examples of the base polymer of the reinforcing layer include two-component curing type epoxy resins and two-component curing type urethane resins.

Figure 2:
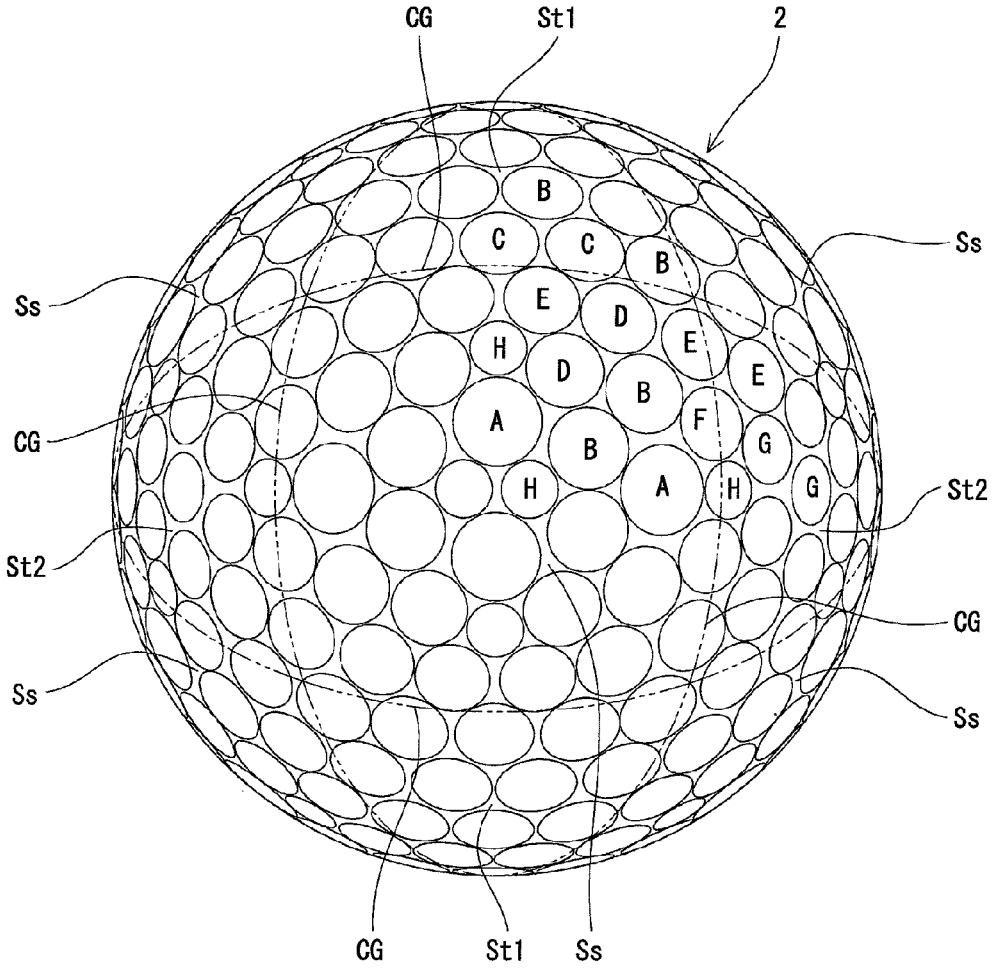
FIG. 2 is an enlarged plan view of the golf ball in FIG. 1.
Figure 3:
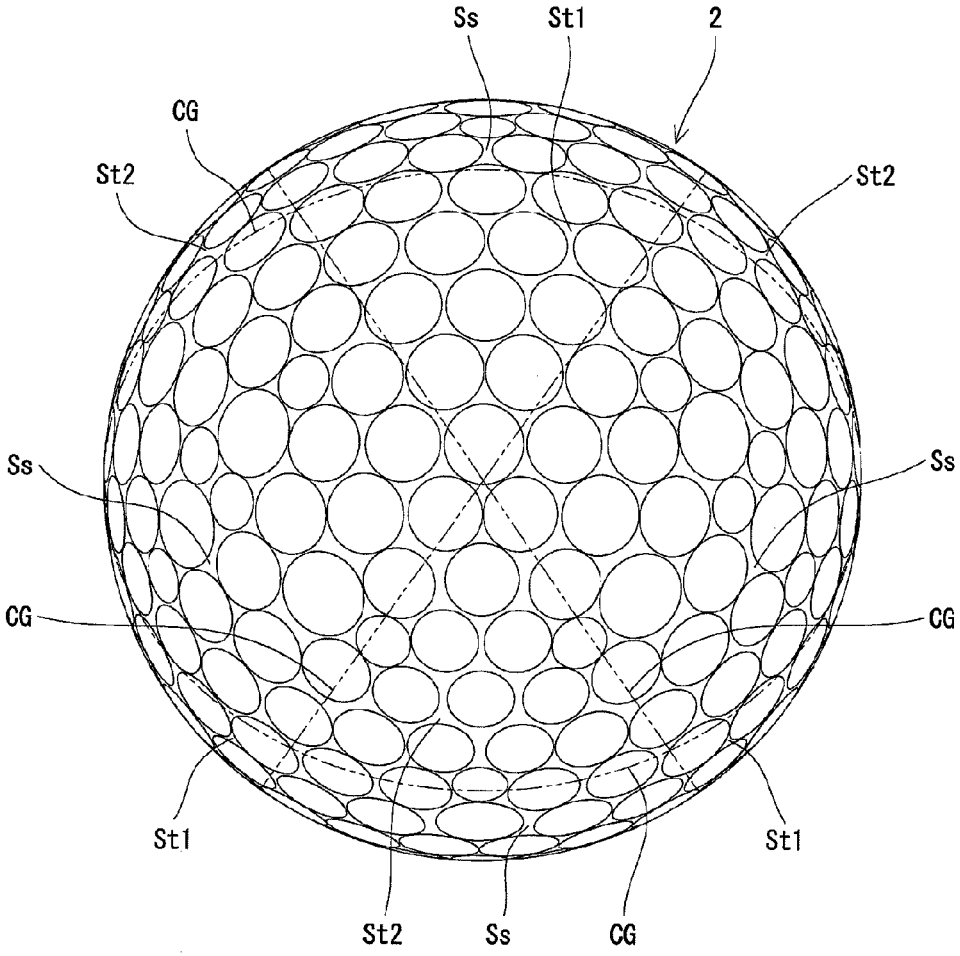
FIG. 3 is a front view of the golf ball in FIG. 2.

As shown in FIGS. 2 and 3, the contour of each dimple 10 is circular. The golf ball 2 has dimples A each having a diameter of 5.00 mm; dimples B each having a diameter of 4.55 mm; dimples C each having a diameter of 4.45 mm; dimples D each having a diameter of 4.35 mm; dimples E each having a diameter of 4.25 mm; dimples F each having a diameter of 4.15 mm; dimples G each having a diameter of 3.85 mm; and dimples H each having a diameter of 3.20 mm. The number of types of the dimples 10 is eight.

The number of the dimples A is 24; the number of the dimples B is 72; the number of the dimples C is 36; the number of the dimples D is 48; the number of the dimples E is 60; the number of the dimples F is 24; the number of the dimples G is 28; and the number of the dimples H is 36. The total number N of the dimples 10 is 328. The standard deviation $\eta$ of the diameters of the dimples 10 is 0.450 mm.

Figure 4:
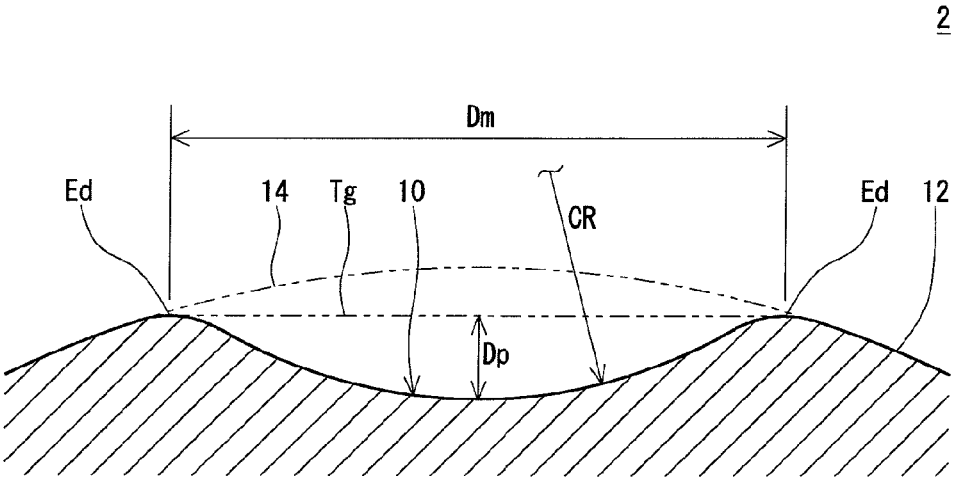
FIG. 4 is a partially enlarged cross-sectional view of the golf ball in FIG. 1.

FIG. 4 shows a cross section along a plane passing through the center of the dimple 10 and the center of the golf ball 2. In FIG. 4, the top-to-bottom direction is the depth direction of the dimple 10. In FIG. 4, what is indicated by a chain double-dashed line 14 is a phantom sphere. The surface of the phantom sphere 14 is the surface of the golf ball 2 when it is postulated that no dimple 10 exists. The dimple 10 is recessed from the surface of the phantom sphere 14. The land 12 coincides with the surface of the phantom sphere 14. In the present embodiment, the cross-sectional shape of each dimple 10 is substantially a circular arc.

In FIG. 4, what is indicated by a double ended arrow Dm is the diameter of the dimple 10. The diameter Dm is the distance between two tangent points Ed appearing on a tangent line Tg that is drawn tangent to the far opposite ends of the dimple 10. Each tangent point Ed is also the edge of the dimple 10. The edge Ed defines the contour of the dimple 10. In FIG. 4, what is indicated by a double ended arrow Dp is the depth of the dimple 10. The depth Dp is the distance between the tangent line Tg and the deepest part of the dimple 10.

In FIG. 4, what is indicated by an arrow CR is the curvature radius of the dimple 10. The curvature radius CR is calculated by the following mathematical formula (1).

$$CR=(Dp^2+Dm^2/4)/(2*Dp) \quad (1)$$

Also in the case of a dimple 10 whose cross-sectional shape is not a circular arc, the curvature radius CR is approximately calculated by the above mathematical formula (1).

In a method for designing the dimple pattern shown in FIGS. 2 and 3, a cuboctahedron is used. In this method, a cuboctahedron inscribed in the phantom sphere 14 is assumed. The cuboctahedron has six squares and eight regular triangles. The cuboctahedron has 24 sides. These sides are projected on the surface of the phantom sphere 14 by a light beam travelling from the center of the phantom sphere 14 in the radius direction, whereby 24 comparting lines are obtained. Six comparting lines are located on the same great circle. By the six comparting lines, one comparting great circle CG is formed. The number of the comparting lines are 24, and thus the number of comparting great circles CG is four. In FIG. 2, the four comparting great circles CG are indicated by imaginary lines. In FIG. 3 as well, the four comparting great circles CG are indicated by imaginary lines.

By the four comparting great circles CG, the surface of the phantom sphere 14 is divided into six spherical quadrangles Ss and eight spherical triangles St. The eight spherical triangles St are composed of four first spherical triangles St1 and four second spherical triangles St2. The shape of each first spherical triangle St1 is the same as the shape of each second spherical triangle St2. The size of each first spherical triangle St1 is the same as the size of each second spherical triangle St1. As is obvious from FIG. 2, one spherical quadrangle Ss is surrounded by two first spherical triangles St1 and two second spherical triangles St2. As is obvious from FIG. 3, one first spherical triangle St1 is surrounded by three spherical quadrangles Ss. One second spherical triangle St2 is also surrounded by three spherical quadrangles Ss.

As is obvious from FIG. 3, the three vertices of each first spherical triangle St1 coincide with vertices of second spherical triangles St2, respectively. In other words, each first spherical triangle St1 does not share vertices with the other first spherical triangles St1. In the golf ball 2, the four first spherical triangles St1 are uniformly distributed. Meanwhile, the three vertices of each second spherical triangle St2 coincide with vertices of first spherical triangles St1, respectively. In other words, each second spherical triangle St2 does not share vertices with the other second spherical triangles St2. In the golf ball 2, the four second spherical triangles St2 are uniformly distributed.

In each spherical quadrangle Ss, a plurality of dimples 10 is located. The dimple patterns of the six spherical quadrangles Ss are the same. Each spherical quadrangle Ss includes four dimples A, eight dimples B, eight dimples D, eight dimples E, four dimples F, and four dimples H. The dimples 10 whose centers are included in a spherical quadrangle Ss are the dimples 10 included in the spherical quadrangle Ss. The dimples 10 whose portions are included in a spherical quadrangle Ss and whose centers are not included in the spherical quadrangle Ss are the dimples 10 that are not included in the spherical quadrangle Ss.

The number N4 of the dimples 10 in each spherical quadrangle Ss is 36. The average A4 of the diameters of the dimples 10 in this spherical quadrangle Ss is 4.29 mm. The standard deviation $\eta 4$ of the diameters of the dimples 10 in this spherical quadrangle Ss is 0.461 mm.

In each first spherical triangle St1, a plurality of dimples 10 is located. This first spherical triangle St1 has a first dimple pattern. The dimple patterns of the four first spherical triangles St1 are the same. Each first spherical triangle St1 includes six dimples B and nine dimples C. The dimples 10 whose centers are included in a first spherical triangles St1 are the dimples 10 included in the first spherical triangle St1. The dimples 10 whose portions are included in a first spherical triangle St1 and whose centers are not included in the first spherical triangle St1 are the dimples 10 that are not included in the first spherical triangle St1.

The number N31 of the dimples 10 in each first spherical triangle St1 is 15. The average A31 of the diameters of the dimples 10 in this first spherical triangle St1 is 4.49 mm. The standard deviation η31 of the diameters of the dimples 10 in this first spherical triangle St1 is 0.051 mm.

In each second spherical triangle St2, a plurality of dimples 10 is located. This second spherical triangle St2 has a second dimple pattern. The dimple patterns of the four second spherical triangles St2 are the same. Each second spherical triangle St2 includes three dimples E, seven dimples G, and three dimples H. The dimples 10 whose centers are included in a second spherical triangle St2 are the dimples 10 included in the second spherical triangle St2. The dimples 10 whose portions are included in a second spherical triangle St2 and whose centers are not included in the second spherical triangle St2 are the dimples 10 that are not included in the second spherical triangle St2.

The number N32 of the dimples 10 in each second spherical triangle St2 is 13. The average A32 of the diameters of the dimples 10 in this second spherical triangle St2 is 3.79 mm. The standard deviation η32 of the diameters of the dimples 10 in this second spherical triangle St2 is 0.377 mm.

The dimple pattern of the golf ball 2 includes the dimple patterns of the spherical quadrangles Ss, the dimple patterns of the first spherical triangles St1, and the dimple patterns of the second spherical triangles St2. The dimple pattern of each first spherical triangle St1 is different from the dimple pattern of each second spherical triangle St2. In the golf ball 2, the dimple pattern is varied. The dimple pattern prompts turbulization. The golf ball 2 has excellent flight performance.

As described above, the standard deviation η31 of each first spherical triangle St1 is 0.051 mm, and the standard deviation η32 of each second spherical triangle St2 is 0.377 mm. The standard deviation η31 is different from the standard deviation η32. In the golf ball 2 in which the standard deviation η31 is different from the standard deviation η32, the dimple pattern is varied. The dimple pattern prompts turbulization. The golf ball 2 has excellent flight performance.

The absolute value of the difference between the standard deviation η31 and the standard deviation η32 is preferably equal to or greater than 0.05 mm. In the golf ball 2 in which this absolute value is equal to or greater than 0.05 mm, turbulization is prompted. In this respect, the absolute value is more preferably equal to or greater than 0.08 mm and particularly preferably equal to or greater than 0.111 mm. The absolute value is preferably equal to or less than 0.5 mm.

The standard deviation η31 is preferably equal to or greater than 0.00 mm but equal to or less than 0.50 mm, and is particularly preferably equal to or greater than 0.05 mm but equal to or less than 0.45 mm. The standard deviation η32 is preferably equal to or greater than 0.00 mm but equal to or less than 0.50 mm, and is particularly preferably equal to or greater than 0.05 mm but equal to or less than 0.45 mm.

As described above, the standard deviation η4 of each spherical quadrangle Ss is 0.461 mm. The standard deviation η4 is different from the standard deviation η31 of each first spherical triangle St1 and is also different from the standard deviation η32 of each second spherical triangle St2. In the golf ball 2, the dimple pattern is varied. The dimple pattern prompts turbulization. The golf ball 2 has excellent flight performance.

In light of turbulization, the standard deviation η4 is preferably greater than the standard deviation η31. The difference between the standard deviation η4 and the standard deviation η31 is preferably equal to or greater than 0.05 mm and particularly preferably equal to or greater than 0.10 mm. The difference is preferably equal to or less than 0.5 mm.

In light of turbulization, the standard deviation η4 is preferably greater than the standard deviation η32. The difference between the standard deviation η4 and the standard deviation η32 is preferably equal to or greater than 0.05 mm and particularly preferably equal to or greater than 0.08 mm. The difference is preferably equal to or greater than 0.5 mm.

The standard deviation η4 is preferably equal to or greater than 0.10 mm but equal to or less than 0.60 mm, and is particularly preferably equal to or greater than 0.15 mm but equal to or less than 0.55 mm.

As described above, the standard deviation η of the golf ball 2 is 0.450 mm. The standard deviation η is different from the standard deviation η31 of each first spherical triangle St1 and is also different from the standard deviation η32 of each second spherical triangle St2. In the golf ball 2, the dimple pattern is varied. The dimple pattern prompts turbulization. The golf ball 2 has excellent flight performance.

In light of turbulization, the standard deviation η is preferably greater than the standard deviation η31. The difference between the standard deviation η and the standard deviation η31 is preferably equal to or greater than 0.05 mm and particularly preferably equal to or greater than 0.10 mm. The difference is preferably equal to or less than 0.5 mm.

In light of turbulization, the standard deviation η is preferably greater than the standard deviation η32. The difference between the standard deviation η and the standard deviation η32 is preferably equal to or greater than 0.05 mm and particularly preferably equal to or greater than 0.07 mm. The difference is preferably equal to or less than 0.5 mm.

The standard deviation η is preferably equal to or greater than 0.10 mm but equal to or less than 0.60 mm, and is particularly preferably equal to or greater than 0.15 mm but equal to or less than 0.55 mm.

In light of turbulization, the standard deviation η4 of each spherical quadrangle Ss is preferably equal to or greater than the standard deviation η of the golf ball 2. The difference between the standard deviation η4 and the standard deviation η is preferably equal to or greater than 0.01 mm. The difference is preferably equal to or less than 0.4 mm.

As is obvious from FIGS. 2 and 3, each comparting great circle CG intersects the dimples 10. In other words, each comparting great circles CG is not a great circle path. The great circle path means a great circle that does not intersect any dimple 10. In the golf ball 2, the difference between the aerodynamic characteristic provided when a line orthogonal to a plane including the comparting great circle CG becomes a rotation axis of backspin and the aerodynamic characteristic provided when another line becomes a rotation axis of backspin, is small. The golf ball 2 has excellent aerodynamic symmetry. In light of aerodynamic symmetry, it is preferred that no great circle path is present on the surface of the phantom sphere 14.

It is preferred that each comparting great circle CG does not coincide with an equator of the golf ball 2. The golf ball 2 is molded by a mold including upper and lower mold halves. The equator is a great circle whose latitude is zero when the deepest point of the upper mold half is assumed as a north pole and the deepest point of the lower mold half is assumed as a south pole. When molding the golf ball 2, a flash is generated near the equator due to the parting line of the mold. The flash is removed by means of cutting or the like. The removal of the flash may cause deformation of the dimples 10 near the equator. Since the equator does not coincide with any comparting great circle CG, the aerodynamic symmetry of the golf ball 2 is not impaired.

In this embodiment, the number of types of the dimple patterns of the spherical triangles St is two. The number of the types may be three or more.

The diameter Dm of each dimple 10 is preferably equal to or greater than 2.0 mm but equal to or less than 6.0 mm. The dimple 10 whose diameter Dm is equal to or greater than 2.0 mm contributes to turbulization. In this respect, the diameter Dm is more preferably equal to or greater than 2.2 mm and particularly preferably equal to or greater than 2.4 mm. The dimple 10 whose diameter Dm is equal to or less than 6.0 mm does not impair a fundamental feature of the golf ball 2 being substantially a sphere. In this respect, the diameter Dm is more preferably equal to or less than 5.8 mm and particularly preferably equal to or less than 5.6 mm.

The area s of the dimple 10 is the area of a region surrounded by the contour line when the center of the golf ball 2 is viewed at infinity. In the case of a circular dimple 10, the area s is calculated by the following mathematical formula.

$$s=(Dm/2)^2*\pi$$

In the golf ball 2 shown in FIGS. 2 and 3, the area of each dimple A is 19.63 $mm^2$; the area of each dimple B is 16.26 $mm^2$; the area of each dimple C is 15.55 $mm^2$; the area of each dimple D is 14.86 $mm^2$; the area of each dimple E is 14.19 $mm^2$; the area of each dimple F is 13.53 $mm^2$; the area of each dimple G is 11.64 $mm^2$; and the area of each dimple H is 8.04 $mm^2$.

The ratio of the sum of the areas s of all the dimples 10 to the surface area of the phantom sphere 14 is referred to as an occupation ratio. In light of turbulization, the occupation ratio is preferably equal to or greater than 60%, more preferably equal to or greater than 70%, and particularly preferably equal to or greater than 80%. The occupation ratio is preferably equal to or less than 95%. In the golf ball 2 shown in FIGS. 2 and 3, the total area of all the dimples 10 is 4706.4 $mm^2$. The surface area of the phantom sphere 14 of the golf ball 2 is 5728.0 $mm^2$, and thus the occupation ratio is 82.2%.

From the standpoint that a sufficient occupation ratio is obtained, the total number N of the dimples 10 is preferably equal to or greater than 200, more preferably equal to or greater than 230, and particularly preferably equal to or greater than 250. From the standpoint that each dimple 10 can contribute to turbulization, the total number N is preferably equal to or less than 500, more preferably equal to or less than 470, and particularly preferably equal to or less than 450.

In the present invention, the term "volume of the dimple" means the volume of a part surrounded by the surface of the dimple 10 and a plane that includes the contour of the dimple 10. In light of suppression of rising of the golf ball 2 during flight, the total volume V of all the dimples 10 is preferably equal to or greater than 250 $mm^3$, more preferably equal to or greater than 260 $mm^3$, and particularly preferably equal to or greater than 270 $mm^3$. In light of suppression of dropping of the golf ball 2 during flight, the total volume V is preferably equal to or less than 400 $mm^3$, more preferably equal to or less than 390 $mm^3$, and particularly preferably equal to or less than 380 $mm^3$.

In light of suppression of rising of the golf ball 2 during flight, the depth Dp of each dimple 10 is preferably equal to or greater than 0.05 mm, more preferably equal to or greater than 0.08 mm, and particularly preferably equal to or greater than 0.100 mm. In light of suppression of dropping of the golf ball 2 during flight, the depth Dp is preferably equal to or less than 0.6 mm, more preferably equal to or less than 0.5 mm, and particularly preferably equal to or less than 0.4 mm.

Figure 5:
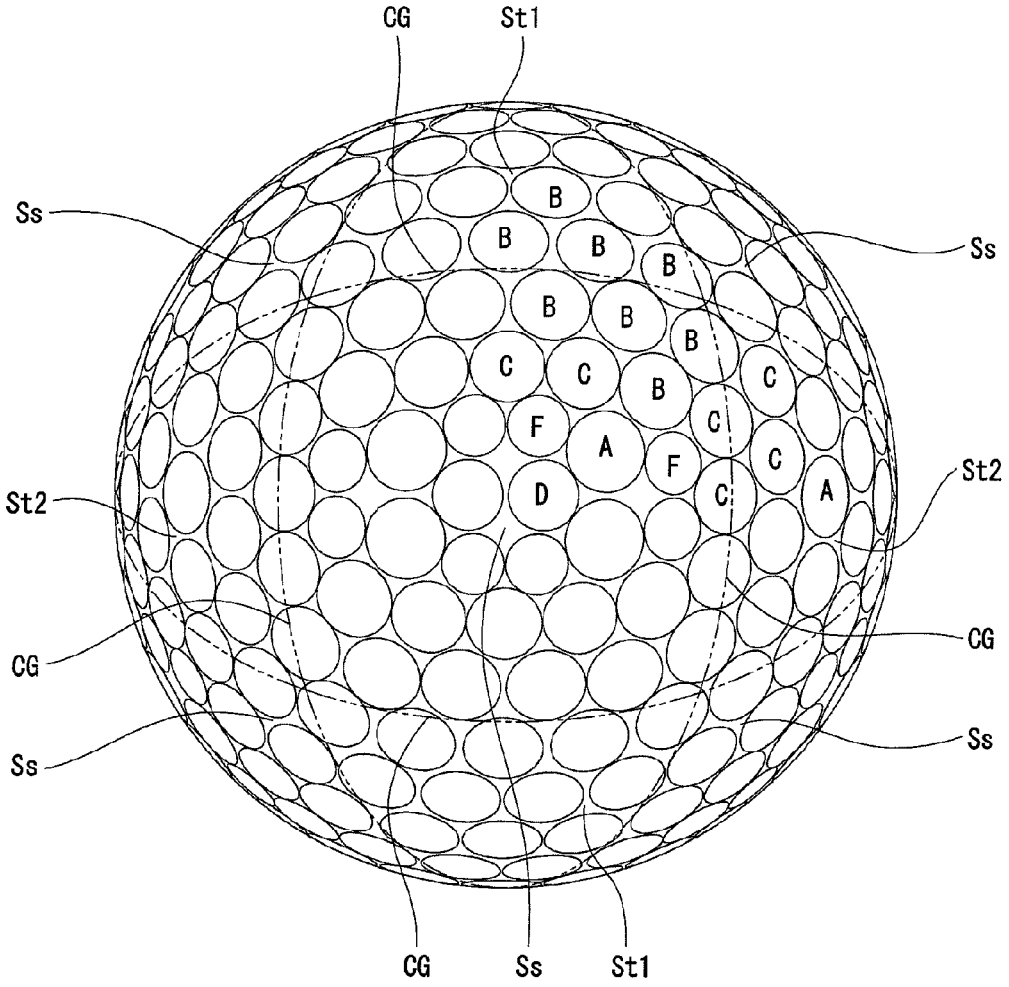
FIG. 5 is a plan view of a golf ball according to another embodiment of the present invention.
Figure 6:
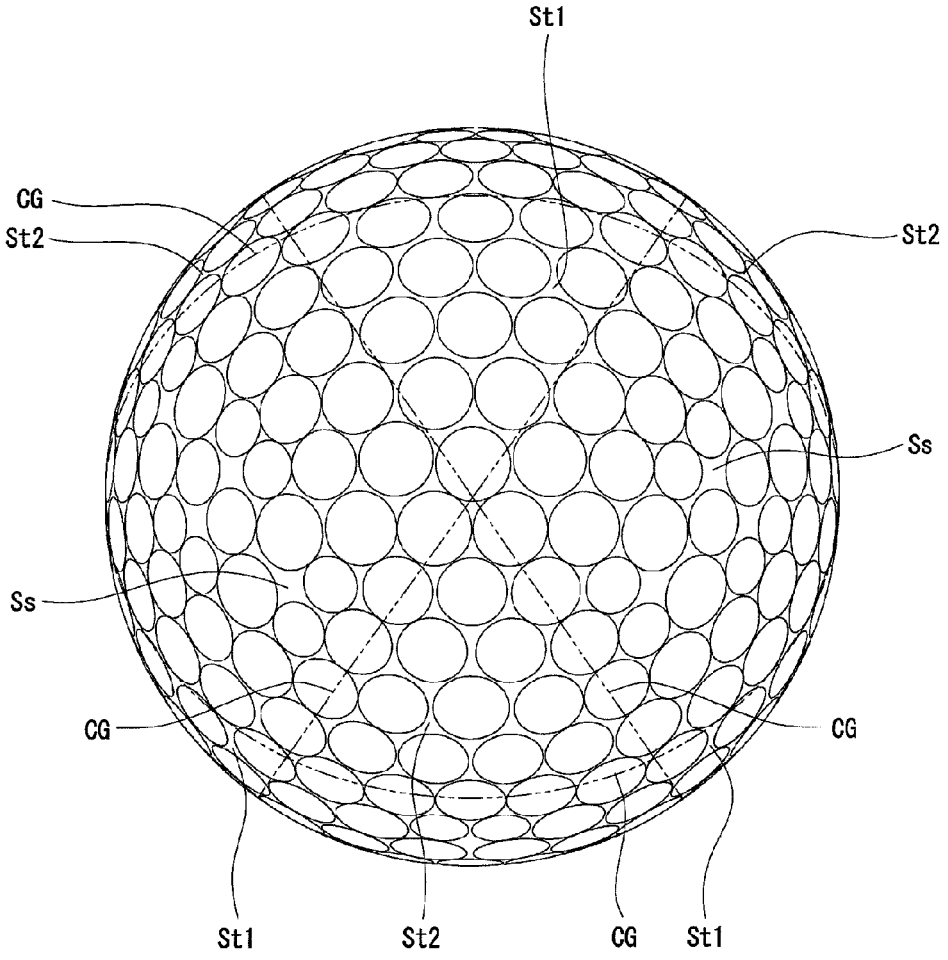
FIG. 6 is a front view of the golf ball in FIG. 5.

FIG. 5 is a plan view of a golf ball 20 according to another embodiment of the present invention. FIG. 6 is a front view of the golf ball 20 in FIG. 5. Although not shown, the golf ball 20 includes a core, a mid layer, and a cover similarly to the golf ball 2 shown in FIG. 1.

In a method for designing the dimple pattern of the golf ball 20 as well, a cuboctahedron is used. By four comparting great circles CG obtained by projecting the 24 sides of the cuboctahedron on the surface of a phantom sphere, the surface of the phantom sphere is divided into six spherical quadrangles Ss and eight spherical triangles St. The eight spherical triangles St are composed of four first spherical triangles St1 and four second spherical triangles St2.

As is obvious from FIG. 5, one spherical quadrangle Ss is surrounded by two first spherical triangles St1 and two second spherical triangles St2. As is obvious from FIG. 6, one first spherical triangle St1 is surrounded by three spherical quadrangles Ss. One second spherical triangle St2 is also surrounded by three spherical quadrangles Ss.

As is obvious from FIG. 6, the three vertices of each first spherical triangle St1 coincide with vertices of second spherical triangles St2, respectively. In other words, each first spherical triangle St1 does not share vertices with the other first spherical triangles St1. Meanwhile, the three vertices of each second spherical triangle St2 coincide with vertices of first spherical triangles St1, respectively. In other words, each second spherical triangle St2 does not share vertices with the other second spherical triangles St2.

In each spherical quadrangle Ss, a plurality of dimples 22 is located. The dimple patterns of the six spherical quadrangles Ss are the same. Each spherical quadrangle Ss includes four dimples A, 16 dimples B, 12 dimples C, two dimples D, and eight dimples E. The number N4 of the dimples 22 in each spherical quadrangle Ss is 42. The average A4 of the diameters of the dimples 22 in this spherical quadrangle Ss is 4.08 mm. The standard deviation $\eta 4$ of the diameters of the dimples 22 in this spherical quadrangle Ss is 0.367 mm.

In each first spherical triangle St1, a plurality of dimples 22 is located. The dimple patterns of the four first spherical triangles St1 are the same. Each first spherical triangle St1 includes 15 dimples B. The number N31 of the dimples 22 in each first spherical triangle St1 is 15. The average A31 of the diameters of the dimples 22 in this first spherical triangle St1 is 4.35 mm. The standard deviation $\eta 31$ of the diameters of the dimples 22 in this first spherical triangle St1 is 0.000 mm.

In each second spherical triangle St2, a plurality of dimples 22 is located. The dimple patterns of the four second spherical triangles St2 are the same. Each second spherical triangle St2 includes one dimple A and nine dimples C. The number N32 of the dimples 22 in each second spherical triangle St2 is 10. The average A32 of the diameters of the dimples 22 in this second spherical triangle St2 is 4.14 mm. The standard deviation $\eta 32$ of the diameters of the dimples 22 in this second spherical triangle St2 is 0.111 mm.

The dimple pattern of the golf ball 20 includes the dimple patterns of the spherical quadrangles Ss, the dimple patterns of the first spherical triangles St1, and the dimple patterns of the second spherical triangles St2. The dimple pattern of each first spherical triangle St1 is different from the dimple pattern of each second spherical triangle St2. In the golf ball 20, the dimple pattern is varied. The dimple pattern prompts turbulization. The golf ball 20 has excellent flight performance.

EXAMPLES

Example 1

A rubber composition was obtained by kneading 100 parts by weight of a high-cis polybutadiene (trade name "BR-730", manufactured by JSR Corporation), 39 parts by weight of zinc diacrylate, 5 parts by weight of zinc oxide, an appropriate amount of barium sulfate, 0.5 parts by weight of diphenyl disulfide, and 0.9 parts by weight of dicumyl peroxide (manufactured by NOF Corporation). The rubber composition was placed into a mold including upper and lower mold halves each having a hemispherical cavity, and heated at 170° C. for 18 minutes to obtain a core with a diameter of 39.75 mm. The amount of barium sulfate was adjusted such that a golf ball with a weight of 45.6 g was obtained.

A resin composition was obtained by kneading 50 parts by weight of an ionomer resin (trade name "Himilan 1605", manufactured by Du Pont-MITSUI POLYCHEMICALS Co., Ltd.), 50 parts by weight of another ionomer resin (trade name "Himilan AM7329", manufactured by Du Pont-MITSUI POLYCHEMICALS Co., Ltd.), 4 parts by weight of titanium dioxide, and 0.04 parts by weight of ultramarine blue with a twin-screw kneading extruder. The core was covered with the resin composition by injection molding to form a mid layer with a thickness of 1.0 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium oxide. The weight ratio of the base material liquid to the curing agent liquid is 1/1. This paint composition was applied to the surface of the mid layer with a spray gun, and kept at 23° C. for 6 hours to obtain a reinforcing layer with a thickness of 10 μm.

A resin composition was obtained by kneading 100 parts by weight of a thermoplastic polyurethane elastomer (trade name "Elastollan XNY85A", manufactured by BASF Japan Ltd.) and 4 parts by weight of titanium dioxide with a twin-screw kneading extruder. Half shells were obtained from the resin composition by compression molding. The sphere consisting of the core, the mid layer, and the reinforcing layer was covered with two of these half shells. The half shells and the sphere were placed into a final mold that includes upper and lower mold halves each having a hemispherical cavity and having a large number of pimples on the cavity face thereof, and a cover was obtained by compression molding. The thickness of the cover was 0.5 mm. A large number of dimples having a shape that is the inverted shape of the pimples were formed on the cover. A clear paint including a two-component curing type polyurethane as a base material was applied to this cover to obtain a golf ball of Example 1 with a diameter of about 42.7 mm and a weight of about 45.6 g. The golf ball has a dimple pattern shown in FIGS. 2 and 3. The detailed specifications of the dimples are shown in Tables 1 and 2 below.

Example 2 and Comparative Examples 1 to 4

Golf balls of Example 2 and Comparative Examples 1 to 4 were obtained in the same manner as Example 1, except the specifications of the dimples were changed. The detailed specifications of the dimples are shown in Tables 1 and 2 below. In the golf balls of Comparative Examples 1 to 3, the dimple pattern of each first spherical triangle is the same as the dimple pattern of each second spherical triangle.

TABLE 1

Specifications of Dimples

| | Type | Diameter (mm) | Curvature radius (mm) | Depth (mm) | Volume ($mm^3$) |
|---|---|---|---|---|---|
| Example 1 | A | 5.00 | 22.88 | 0.1370 | 1.346 |
| | B | 4.55 | 18.96 | 0.1370 | 1.115 |
| | C | 4.45 | 18.14 | 0.1370 | 1.067 |
| | D | 4.35 | 17.33 | 0.1370 | 1.019 |
| | E | 4.25 | 16.55 | 0.1370 | 0.973 |
| | F | 4.15 | 15.78 | 0.1370 | 0.928 |
| | G | 3.85 | 13.59 | 0.1370 | 0.799 |
| | H | 3.20 | 9.41 | 0.1370 | 0.552 |
| Example 2 | A | 4.45 | 18.40 | 0.1350 | 1.051 |
| | B | 4.35 | 17.59 | 0.1350 | 1.004 |
| | C | 4.10 | 15.63 | 0.1350 | 0.892 |
| | D | 3.85 | 13.79 | 0.1350 | 0.787 |
| | E | 3.40 | 10.77 | 0.1350 | 0.614 |
| Compa. Example 1 | A | 3.90 | 11.27 | 0.1700 | 1.018 |
| | B | 3.65 | 9.88 | 0.1700 | 0.892 |
| Compa. Example 2 | A | 3.85 | 12.11 | 0.1540 | 0.898 |
| | B | 3.65 | 10.96 | 0.1530 | 0.802 |
| | C | 3.40 | 9.58 | 0.1520 | 0.692 |
| Compa. Example 3 | A | 4.25 | 15.64 | 0.1450 | 1.030 |
| | B | 3.78 | 12.39 | 0.1450 | 0.815 |
| | C | 3.58 | 11.12 | 0.1450 | 0.731 |
| | D | 3.00 | 7.83 | 0.1450 | 0.514 |
| Compa. Example 4 | A | 5.20 | 24.92 | 0.1360 | 1.445 |
| | B | 4.45 | 18.27 | 0.1360 | 1.059 |
| | C | 4.35 | 17.46 | 0.1360 | 1.012 |
| | D | 4.10 | 15.52 | 0.1360 | 0.899 |
| | E | 3.85 | 13.69 | 0.1360 | 0.793 |
| | F | 3.20 | 9.48 | 0.1360 | 0.548 |

TABLE 2

Number of Dimples

| | Type | Spherical quadrangle | First spherical triangle | Second spherical triangle | Total |
|---|---|---|---|---|---|
| Example 1 | A | 4 | 0 | 0 | 24 |
| | B | 8 | 6 | 0 | 72 |
| | C | 0 | 9 | 0 | 36 |
| | D | 8 | 0 | 0 | 48 |
| | E | 8 | 0 | 3 | 60 |
| | F | 4 | 0 | 0 | 24 |
| | G | 0 | 0 | 7 | 28 |
| | H | 4 | 0 | 3 | 36 |
| Example 2 | A | 4 | 0 | 1 | 28 |
| | B | 16 | 15 | 0 | 156 |
| | C | 12 | 0 | 9 | 108 |
| | D | 2 | 0 | 0 | 12 |
| | E | 8 | 0 | 0 | 48 |
| Compa. Example 1 | A | 12 | 9 | 9 | 144 |
| | B | 25 | 6 | 6 | 198 |
| Compa. Example 2 | A | 12 | 3 | 3 | 96 |
| | B | 20 | 0 | 0 | 120 |
| | C | 9 | 18 | 18 | 198 |
| Compa. Example 3 | A | 4 | 0 | 0 | 24 |
| | B | 32 | 0 | 0 | 192 |
| | C | 0 | 9 | 9 | 72 |
| | D | 12 | 12 | 12 | 168 |
| Compa. Example 4 | A | 1 | 0 | 0 | 6 |
| | B | 8 | 15 | 15 | 168 |
| | C | 8 | 0 | 0 | 48 |
| | D | 4 | 0 | 0 | 24 |
| | E | 8 | 0 | 0 | 48 |
| | F | 8 | 0 | 0 | 48 |

[Flight Distance Test]

A driver with a titanium head (trade name "Z-TX", manufactured by SRI Sports Limited, shaft hardness: X, loft angle: 8.5°) was attached to a swing machine manufactured by Golf Laboratories, Inc. A golf ball was hit under the condition of a head speed of 50 m/sec, and the distance from the launch point to the stop point was measured. At the test, the weather was almost windless. The average value of data obtained by 20 measurements is shown in Tables 3 and 4 below.

TABLE 3

Specifications and Evaluation Results of Dimples

Figure 7:
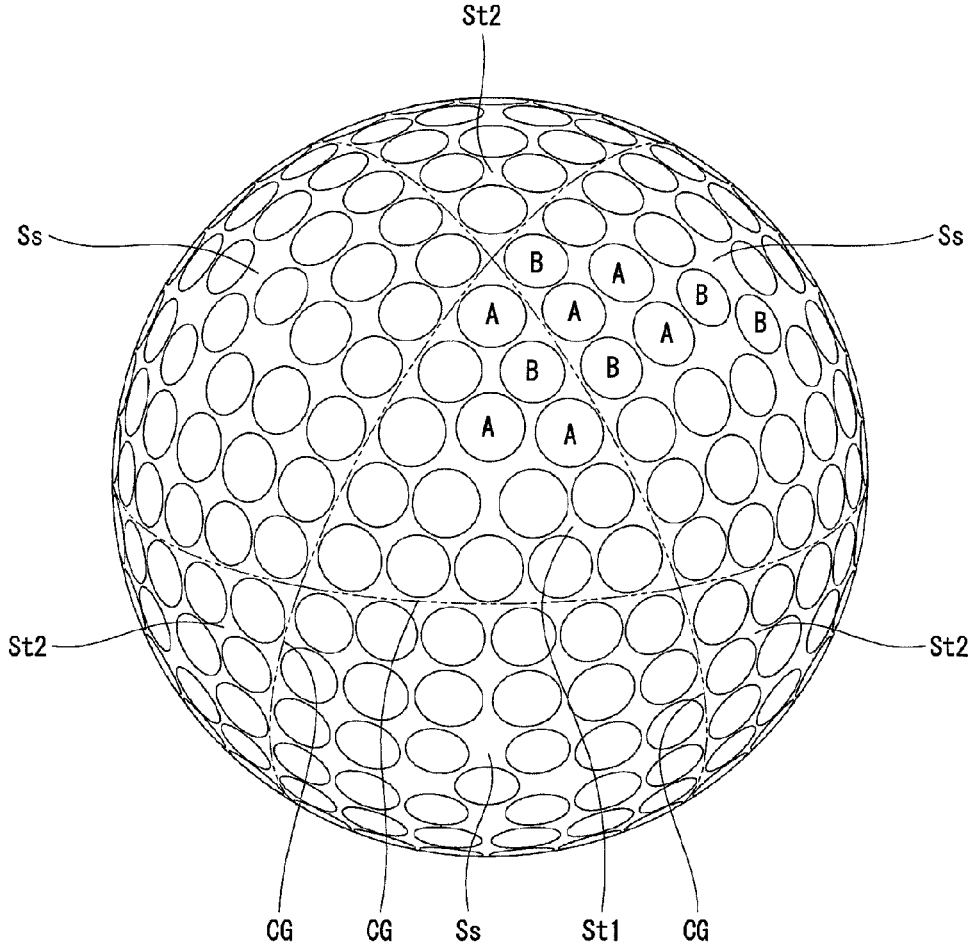
FIG. 7 is a plan view of a golf ball according to Comparative Example 1.
Figure 8:
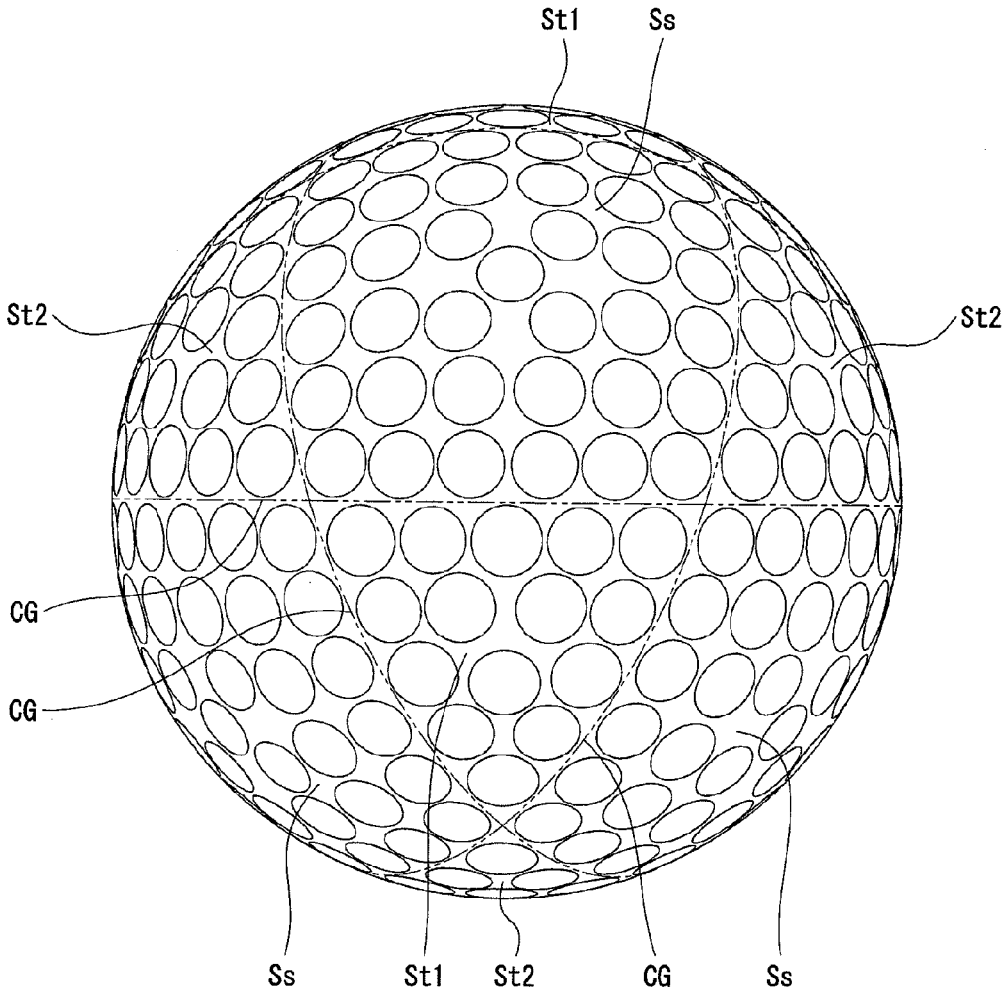
FIG. 8 is a front view of the golf ball in FIG. 7.

| | | Example 1 | Example 2 | Compa. Example 1 |
|---|---|---|---|---|
| Plan view | | FIG. 2 | FIG. 5 | FIG. 7 |
| Front view | | FIG. 3 | FIG. 6 | FIG. 8 |
| Spherical quadrangle | Number N4 | 36 | 42 | 37 |
| | Average A4 (mm) | 4.29 | 4.08 | 3.73 |
| | η4 (mm) | 0.461 | 0.367 | 0.119 |
| First spherical triangle | Number N31 | 15 | 15 | 15 |
| | Average A31 (mm) | 4.49 | 4.35 | 3.80 |
| | η31 (mm) | 0.051 | 0.000 | 0.127 |
| Second spherical triangle | Number N32 | 13 | 10 | 15 |
| | Average A32 (mm) | 3.79 | 4.14 | 3.80 |
| | η32 (mm) | 0.377 | 0.111 | 0.127 |
| Total number N | | 328 | 352 | 342 |
| Total volume V ($mm^3$) | | 322.8 | 321.4 | 323.2 |
| Occupation ratio (%) | | 82.2 | 83.0 | 66.2 |
| η (mm) | | 0.450 | 0.325 | 0.124 |
| Number of great circle paths | | 0 | 0 | 4 |
| Absolute value of (η31 − η32) | | 0.326 | 0.111 | 0.000 |
| η4 − η | | 0.010 | 0.042 | −0.005 |
| η − η31 | | 0.400 | 0.325 | −0.003 |
| η − η32 | | 0.073 | 0.214 | −0.003 |
| η4 − η31 | | 0.410 | 0.367 | −0.008 |
| η4 − η32 | | 0.084 | 0.256 | −0.008 |
| Flight distance (m) | | 260.5 | 259.8 | 255.5 |

TABLE 4

Specifications and Evaluation Results of Dimples

Figure 9:
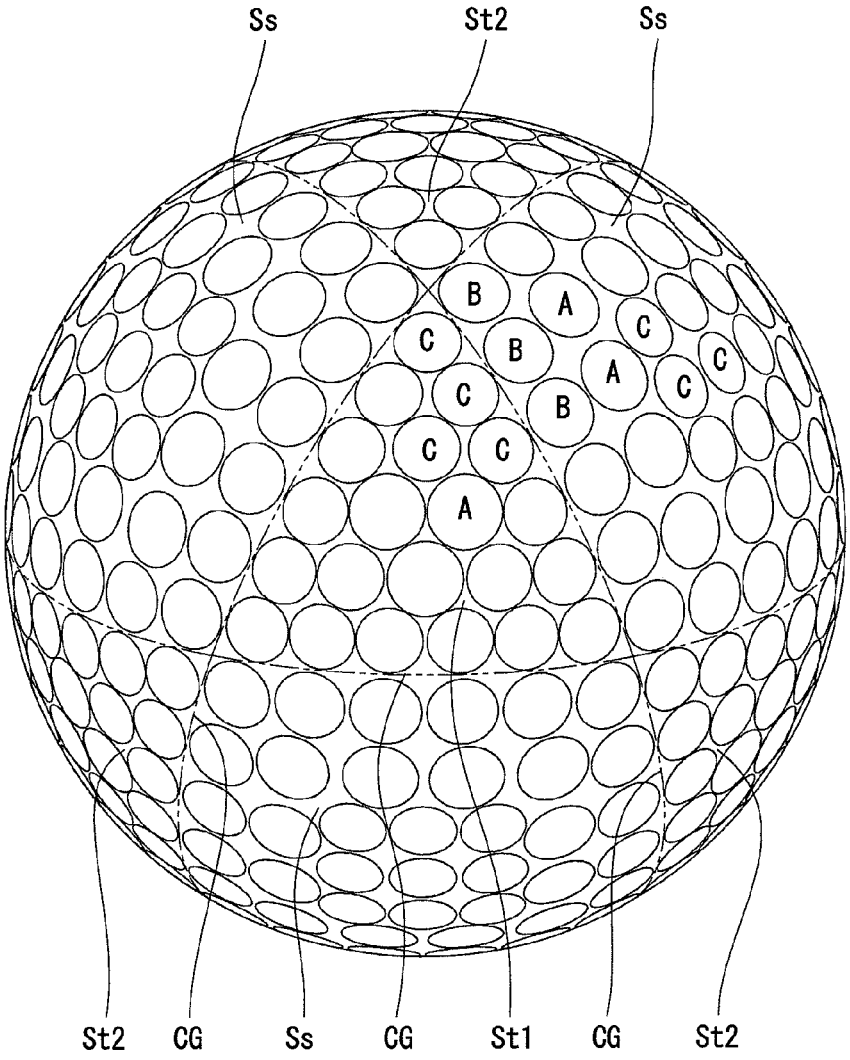
FIG. 9 is a plan view of a golf ball according to Comparative Example 2.
Figure 10:
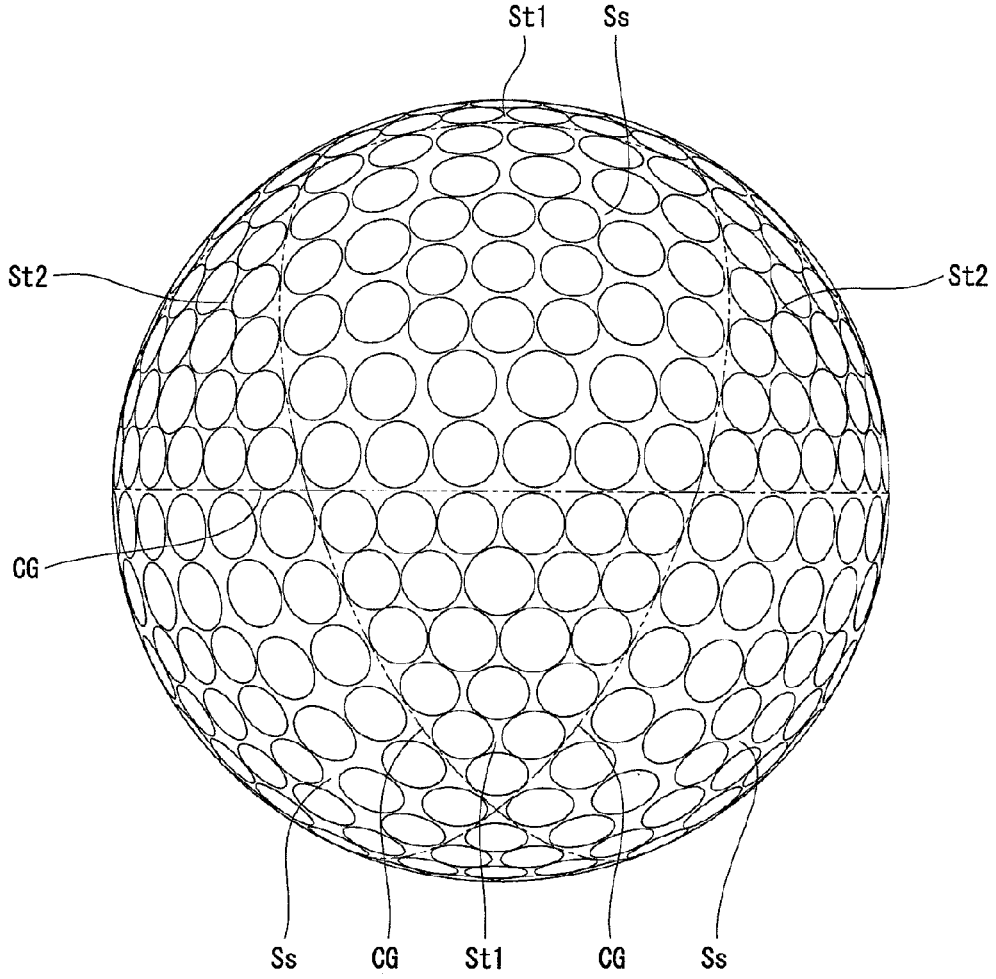
FIG. 10 is a front view of the golf ball in FIG. 9.
Figure 11:
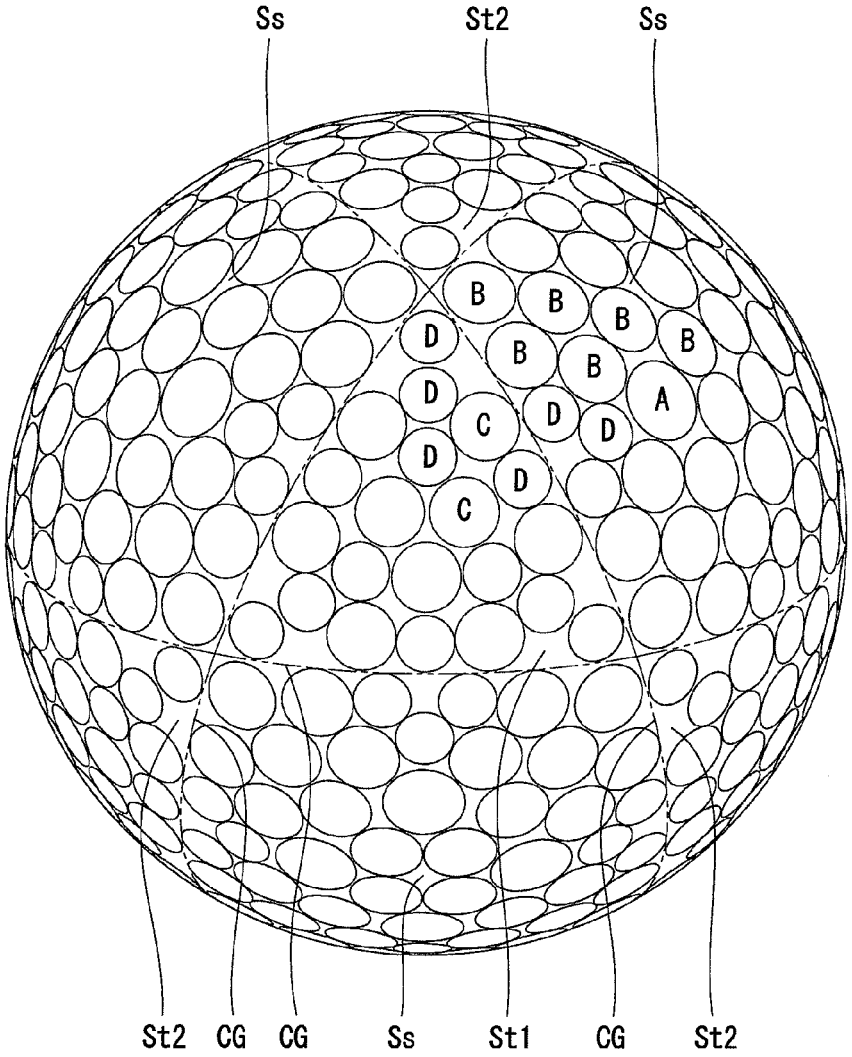
FIG. 11 is a plan view of a golf ball according to Comparative Example 3.
Figure 12:
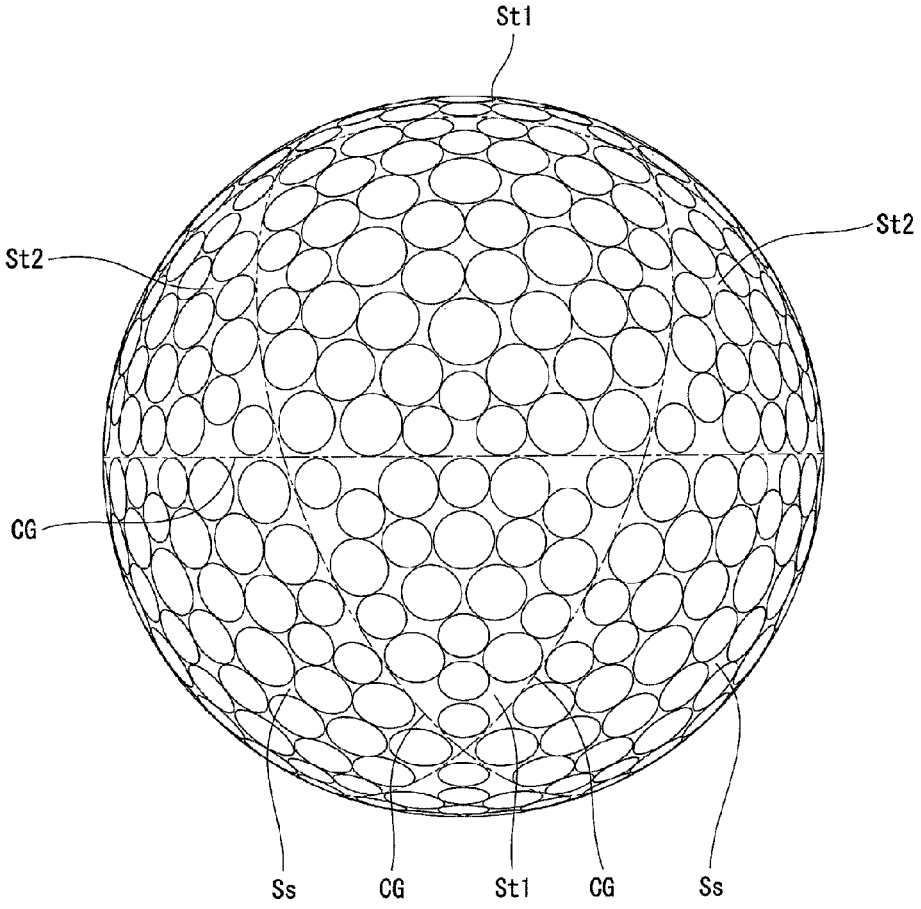
FIG. 12 is a front view of the golf ball in FIG. 11.
Figure 13:
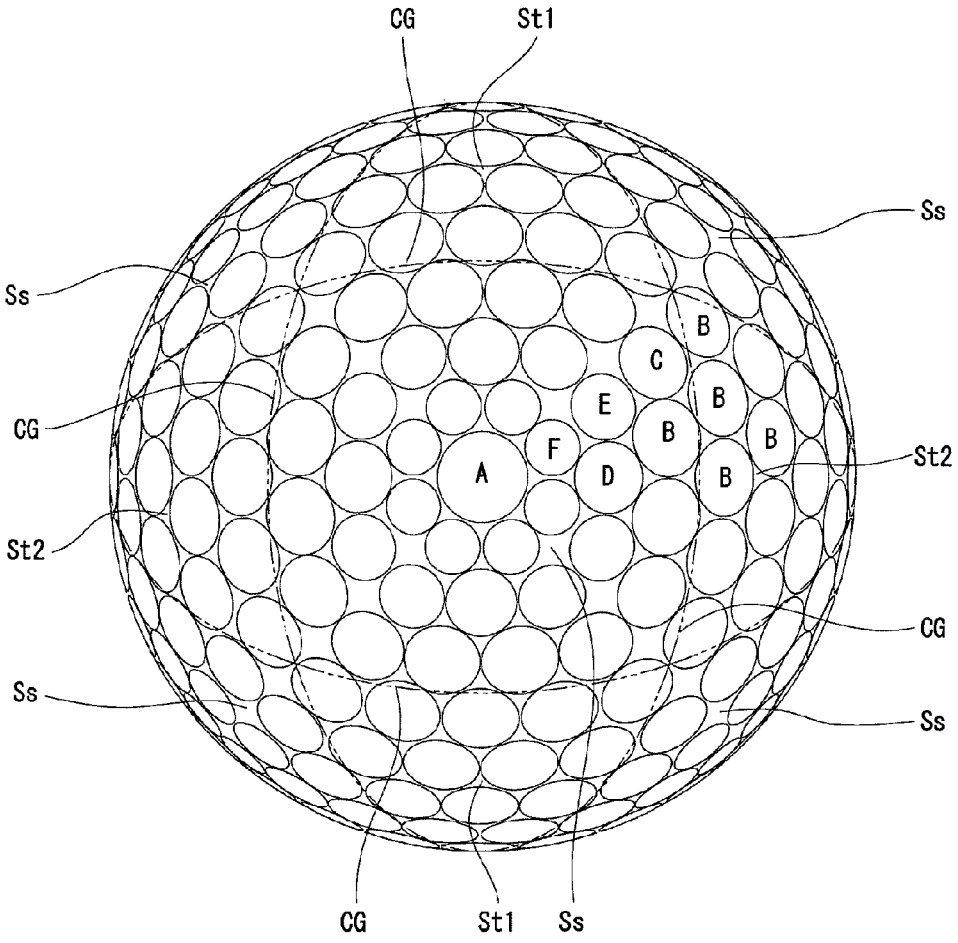
FIG. 13 is a plan view of a golf ball according to Comparative Example 4.
Figure 14:
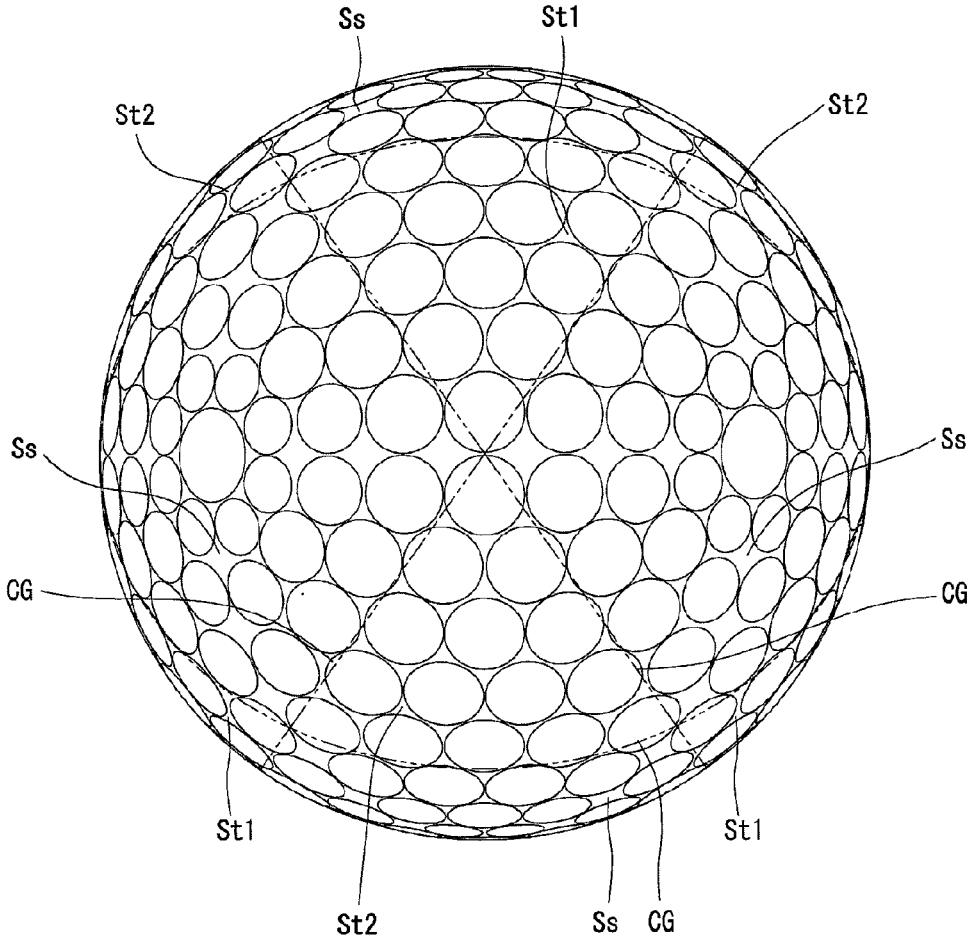
FIG. 14 is a front view of the golf ball in FIG. 13.

| | | Compa. Example 2 | Compa. Example 3 | Compa. Example 4 |
|---|---|---|---|---|
| Plan view | | FIG. 9 | FIG. 11 | FIG. 13 |
| Front view | | FIG. 10 | FIG. 12 | FIG. 14 |
| Spherical quadrangle | Number N4 | 41 | 48 | 32 |
| | Average A4 (mm) | 3.65 | 3.62 | 4.01 |
| | η4 (mm) | 0.161 | 0.386 | 0.510 |
| First spherical triangle | Number N31 | 21 | 21 | 15 |
| | Average A31 (mm) | 3.46 | 3.25 | 4.45 |
| | η31 (mm) | 0.161 | 0.294 | 0.000 |
| Second spherical triangle | Number N32 | 21 | 21 | 15 |
| | Average A32 (mm) | 3.46 | 3.25 | 4.45 |
| | η32 (mm) | 0.161 | 0.294 | 0.000 |
| Total number N | | 414 | 456 | 342 |
| Total volume V ($mm^3$) | | 319.5 | 320.3 | 321.1 |
| Occupation ratio (%) | | 72.8 | 76.9 | 82.3 |
| η (mm) | | 0.184 | 0.395 | 0.475 |
| Number of great circle paths | | 4 | 4 | 0 |
| Absolute value of (η31 − η32) | | 0.000 | 0.000 | 0.000 |
| η4 − η | | −0.023 | −0.008 | 0.053 |
| η − η31 | | 0.023 | 0.101 | 0.457 |
| η − η32 | | 0.023 | 0.101 | 0.457 |
| η4 − η31 | | 0.000 | 0.092 | 0.510 |
| η4 − η32 | | 0.000 | 0.092 | 0.510 |
| Flight distance (m) | | 257.0 | 258.3 | 258.5 |

As shown in Tables 3 and 4, the golf ball of each Example has excellent flight performance. From the results of evaluation, advantages of the present invention are clear.

The aforementioned dimples are applicable to a one-piece golf ball, a two-piece golf ball, a four-piece golf ball, a five-piece golf ball, and a thread-wound golf ball, in addition to a three-piece golf ball. The above descriptions are merely for illustrative examples, and various modifications can be made without departing from the principles of the present invention.

What is claimed is:

1. A golf ball having a large number of dimples on a surface thereof, wherein when a surface of a phantom sphere of the golf ball is divided into six spherical quadrangles and eight spherical triangles by four comparting great circles which are formed by projecting sides of a cuboctahedron inscribed in the phantom sphere on the surface of the phantom sphere, the eight spherical triangles include four spherical triangles each having a first dimple pattern, and four spherical triangles each having a second dimple pattern different from the first dimple pattern.

2. The golf ball according to claim 1, wherein each spherical triangle having the first dimple pattern does not share vertices with the other spherical triangles each having the first dimple pattern, and each spherical triangle having the second dimple pattern does not share vertices with the other spherical triangles each having the second dimple pattern.

3. The golf ball according to claim 1, wherein a standard deviation η31 of diameters of dimples in the first dimple pattern is different from a standard deviation η32 of diameters of dimples in the second dimple pattern.

4. The golf ball according to claim 3, wherein an absolute value of a difference between the standard deviation η31 and the standard deviation η32 is equal to or greater than 0.05 mm.

5. The golf ball according to claim 1, wherein a standard deviation η4 of diameters of dimples in a dimple pattern of each spherical quadrangle is different from a standard deviation η31 of diameters of dimples in the first dimple pattern and is different from a standard deviation η32 of diameters of dimples in the second dimple pattern.

6. The golf ball according to claim 5, wherein the standard deviation η4 is greater than the standard deviation η31 and is greater than the standard deviation η32.

7. The golf ball according to claim 6, wherein the difference between the standard deviation η4 and the standard deviation η31 is equal to or greater than 0.05 mm but equal to or less than 0.5 mm, and the difference between the standard deviation η4 and the standard deviation η32 is equal to or greater than 0.05 mm but equal to or less than 0.5 mm.

8. The golf ball according to claim 1, wherein a standard deviation η of diameters of all the dimples of the golf ball is different from a standard deviation η31 of diameters of dimples in the first dimple pattern and is different from a standard deviation η32 of diameters of dimples in the second dimple pattern.

9. The golf ball according to claim 8, wherein the standard deviation η is greater than the standard deviation η31 and is greater than the standard deviation η32.

10. The golf ball according to claim 9, wherein the difference between the standard deviation η and the standard deviation η31 is equal to or greater than 0.05 mm but equal to or less than 0.5 mm, and the difference between the standard deviation η and the standard deviation η32 is equal to or greater than 0.05 mm but equal to or less than 0.5 mm.

11. The golf ball according to claim 1, wherein a standard deviation η4 of diameters of dimples in a dimple pattern of each spherical quadrangle is equal to or greater than a standard deviation η of diameters of all the dimples of the golf ball.

12. The golf ball according to claim 1, wherein each of the four computing great circles intersects the dimples.

13. The golf ball according to claim 12, wherein no great circle which does not intersect any dimple is present on the surface of the phantom sphere.

14. The golf ball according to claim 1, wherein each of the four computing great circles does not coincide with an equator of the golf ball.

15. The golf ball according to claim 1, wherein a standard deviation $\eta 31$ of diameters of dimples in the first dimple pattern is equal to or less than 0.50 mm, and a standard deviation $\eta 32$ of diameters of dimples in the second dimple pattern is equal to or less than 0.50 mm.

16. The golf ball according to claim 1, wherein a standard deviation $\eta 4$ of diameters of dimples in a dimple pattern of each spherical quadrangle is equal to or greater than 0.10 mm but equal to or less than 0.60 mm.

17. The golf ball according to claim 1, wherein a standard deviation $\eta$ of diameters of all the dimples of the golf ball is equal to or greater than 0.10 mm but equal to or less than 0.60 mm.

* * * * *